US006401575B1

(12) United States Patent
Shively et al.

(10) Patent No.: US 6,401,575 B1
(45) Date of Patent: Jun. 11, 2002

(54) WRENCH FOR FUEL FILTER HOUSING COVERS

(75) Inventors: Terrance A. Shively, Ann Arbor, MI (US); Willie L. Stamey, Kings Mountain; Mark A. Roll, Bessemer City, both of NC (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/881,014

(22) Filed: Jun. 15, 2001

(51) Int. Cl.[7] ..... B25B 13/48
(52) U.S. Cl. ..... 81/176.15; 81/121.1
(58) Field of Search ..... 81/176.15, 176.2, 81/119, 121.1, 124.2

(56) References Cited

U.S. PATENT DOCUMENTS 3,768,345 A 10/1973 Barnes
4,831,904 A 5/1989 Agins
D311,315 S 10/1990 Duke
5,003,681 A 4/1991 Schley
5,618,143 A 4/1997 Cronin, II et al.
5,845,552 A 12/1998 Piascik
5,887,496 A 3/1999 Pollard et al.
6,082,230 A 7/2000 Steinweg
6,321,625 B1 * 11/2001 Fernandez ..... 81/176.2

* cited by examiner

*Primary Examiner*—Joseph J. Hail, III
*Assistant Examiner*—David B. Thomas
(74) *Attorney, Agent, or Firm*—Millen, White, Zelano & Branigan, P.C.

(57) ABSTRACT

A wrench cap of molded plastic defines an interior space into which project a plurality of lugs. The lugs engage ribs projecting from a threaded cover for a fuel filter housing. A conventional wrench or wrench handle cooperates with a hex coupling on the wrench cap to rotate the wrench cap and thus the threaded cover. This facilitates removal of the cover from the fuel filter housing so that a filter element in the housing can be changed.

11 Claims, 7 Drawing Sheets

WRENCH FOR FUEL FILTER HOUSING COVERS

FIELD OF THE INVENTION

The present invention is directed to wrenches for fuel filter housing covers. More particularly, the present invention is directed to wrenches for fuel filter housing covers which cooperate with projecting features on the fuel filter covers to facilitate loosening and removing fuel filter covers.

BACKGROUND OF THE INVENTION

A large number of vehicles manufactured from 1994 to the present utilize cartridge-style fuel filter housings having injection molded, ribbed housing covers. The fuel filter housings are positioned on engines at locations which make access to the housings and covers very difficult so that the mechanic or other person making filter changes must strain to access housing covers for removal, which is the first step in changing filter elements within the housings. The housing covers have a diameter which is too large to be grasped by hand so that screw drivers are used to force housing covers open. Utilizing a screwdriver for this task is difficult in of itself and can lead to warped housing covers which can result in fuel leaks while vehicles are in operation. Accordingly, there is a need for a tool which can conveniently grip these fuel filter housings so that mechanics need not resort to using screwdrivers which can result in hazardous fuel leaks.

SUMMARY OF THE INVENTION

In view of the aforementioned considerations, the present invention is directed to a wrench adapted to remove a cover of a fuel filter housing, wherein the cover includes a top surface with a peripheral portion and an array of radial ribs having a selected radial extent terminating at a peripheral portion to define a rib-free area of a selected width and maximum diameter. The cover also has a threaded portion thereon for threadably coupling with a threaded mouth of the housing to retain a filter element within the housing. In accordance with the invention, the wrench comprises a disk having a diameter larger than the radial extend of the ribs and includes a flange extending from the disk which encloses a space having a diameter larger than the radial extent of the ribs, but less than the maximum diameter of the peripheral portion. The flange is adapted to engage the peripheral portion of the top surface of the cover and has a plurality of lugs spaced from one another and extending inwardly from the flange. The lugs are adapted to engage the ribs in a circumferential direction to apply torque to the cover, while the flange is adapted to engage the ends of the ribs in a radial direction to keep the disk correctly positioned radially with respect to the cover. A coupling on the disk is adapted to couple with a wrench handle for applying torque to the disk.

In accordance with a more specific aspect of the invention, the coupling on the disk has a surface configuration adapted to complement a surface configuration on the handle wherein the handle is, for example, a projecting hex nut having a square aperature therethrough.

In still a further aspect of the invention, the wrench is configured for cooperation with at least two cover configurations, wherein one cover configuration has an array of straight linear ribs and another cover has T-shaped ribs with arcuate lateral portions having gaps therebetween for receiving the lugs on the wrench.

In a more specific aspect of the invention, there are six lugs on the wrench for cooperation with six ribs on the cover.

DETAILED DESCRIPTION

Figure 1:
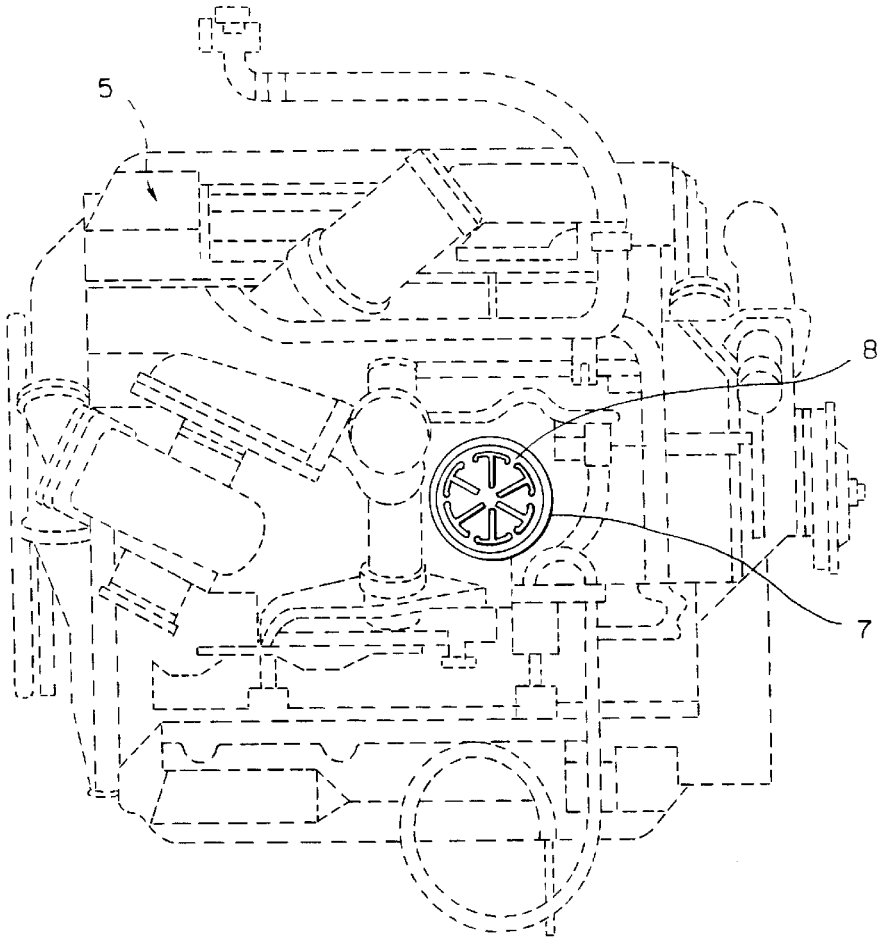
FIG. 1 is a side view of an engine shown in dotted lines with a fuel filter housing configured for cooperation with the wrench of the present invention.

Referring now to FIG. 1, there is shown an engine 5 having a filter housing 7 with a circular cover 8 thereon, which circular cover is accessed by a cap wrench configured in accordance with the present invention.

Figure 2:
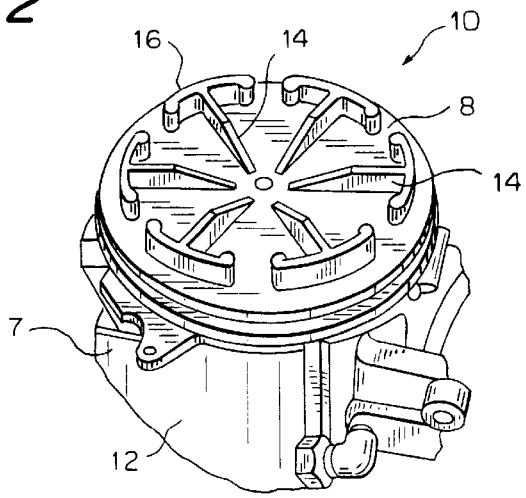
FIG. 2 is a perspective view of the fuel filter housing of FIG. 1.
Figure 3:
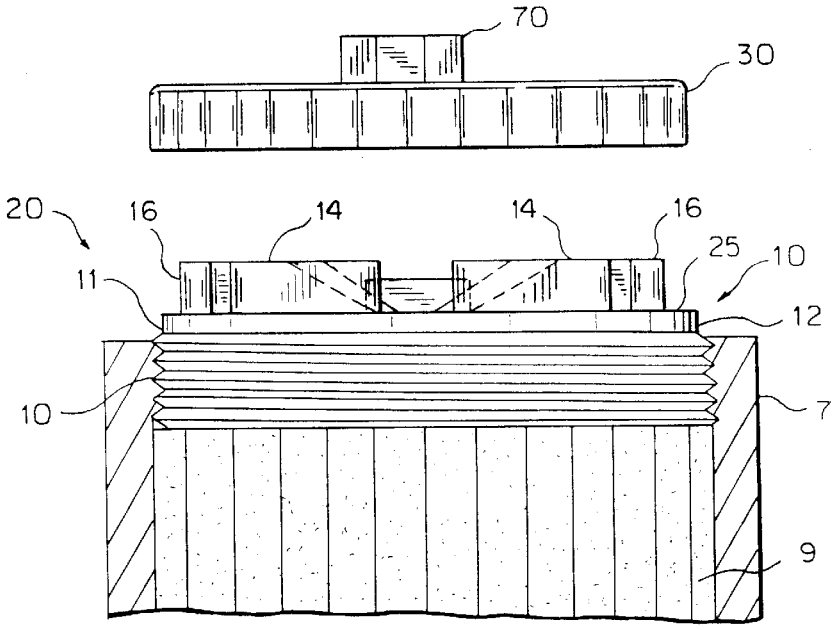
FIG. 3 is a side view, partially in elevation, of the fuel filter housing of FIG. 2 showing a filter element retained in the housing by a cover.
Figure 4:
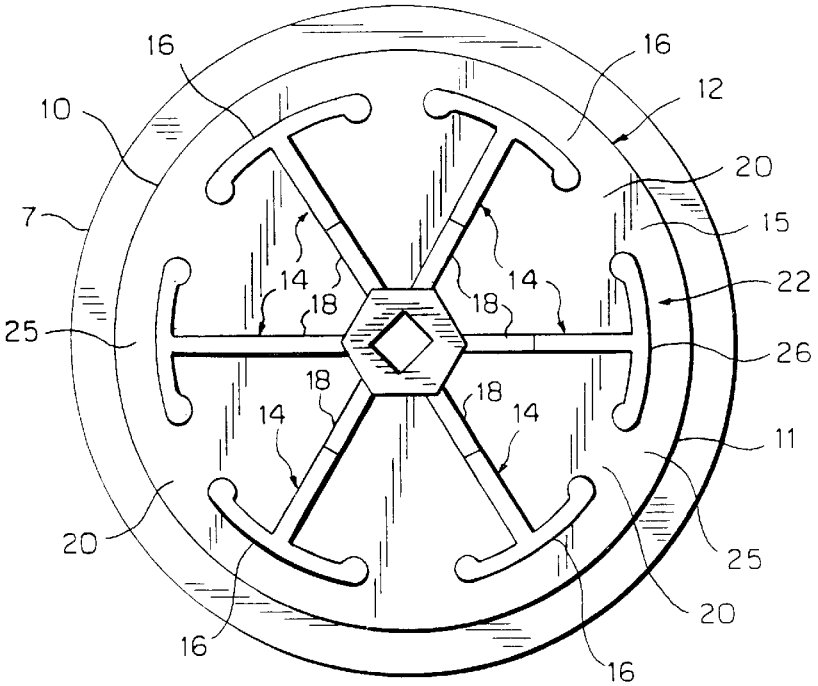
FIG. 4 is a top view of the cover in FIG. 3.

Referring now to FIGS. 2–4 where the housing 7 and cover 8 are shown in isolation, it is seen that the housing 7 contains a filter element 9 which is held within the housing 7 by the cover 8. The housing 7 has an internally threaded mouth 10 to which an externally threaded portion 11 of the cover 8, which projects from a disk portion 12 thereon is threadably received to seal the filter element 9 within the housing 7.

Fixed ribs 14 project from the top surface 15 of the disk 12 of the housing 8 in the illustrated first embodiment of FIGS. 2–4. The ribs 14 are T-shaped with arcuate cross member 16 projecting laterally from radially extending rib portions 18. Between the cross member 16, are gaps 20. The ribs 14 have a radial extent which is less than the diameter D of the disk 12 so as to define a peripheral portion 25 on the disk 12 which has a width between the ends 26 of the ribs and the diameter D of the disk.

Figure 5:
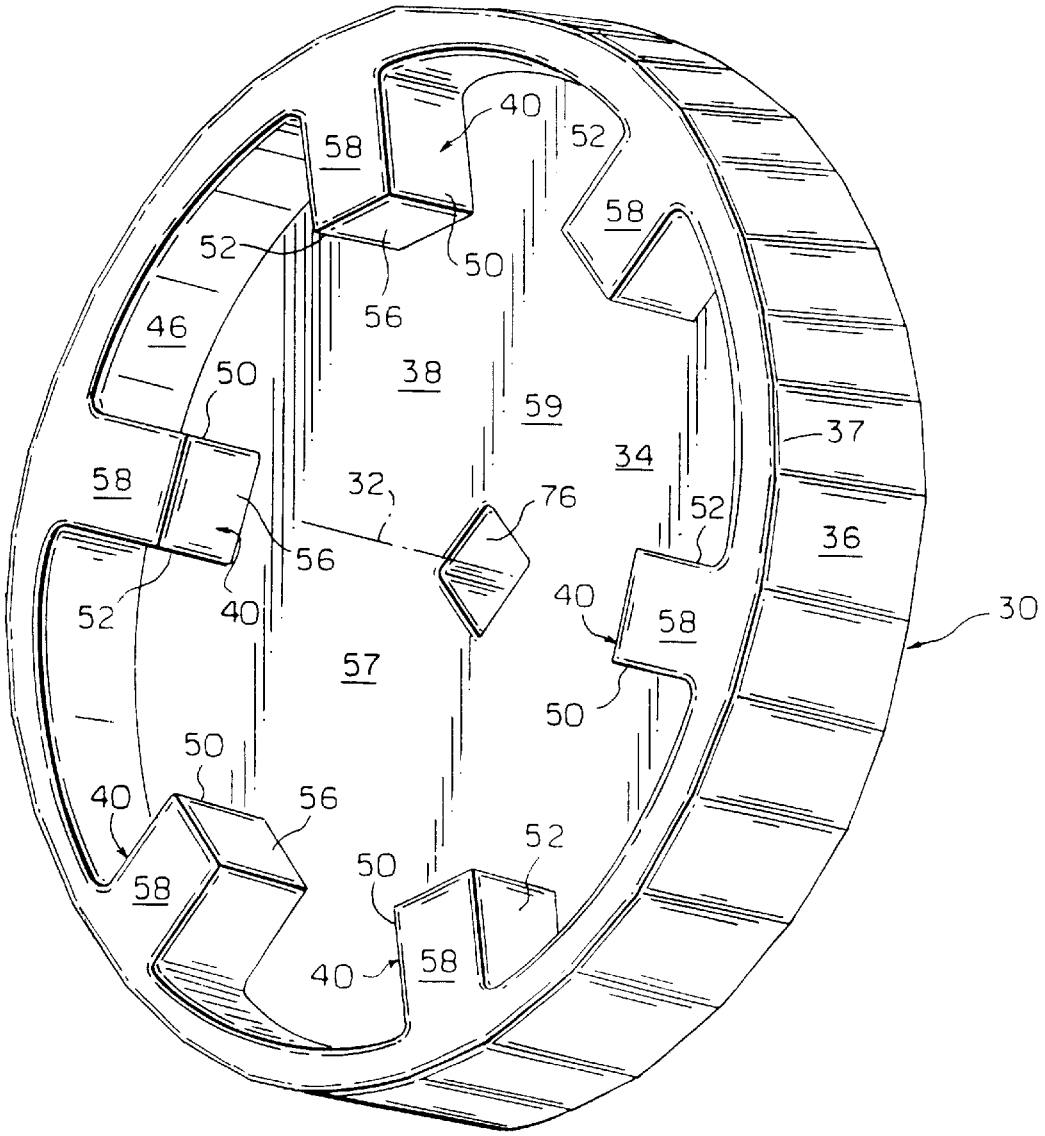
FIG. 5 is a perspective view of the inside of a wrench cap configured in accordance with the principals of the present invention.
Figure 6:
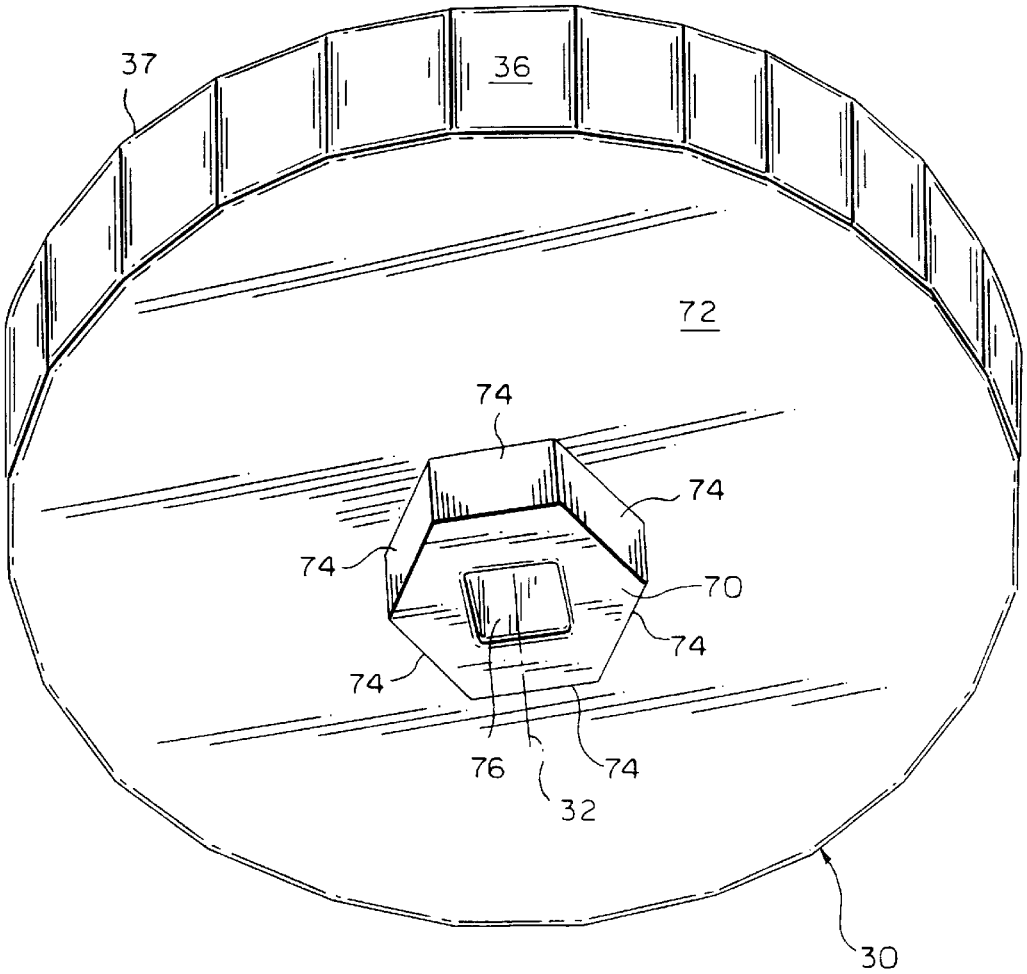
FIG. 6 is a perspective outside view of the wrench cap FIG. 5.

As is seen in FIGS. 3, 5 and 6 a wrench cap 30, configured in accordance with the principals of the present invention, cooperates with the configuration of the top surface 15 and the ribs 14 of the cover 8 in order to apply torque thereto, so as to facilitate rotation of the cover with respect to the housing 7, thus allowing the cover easily removed in order to change the filter element 9 (FIG. 3). As is seen in FIG. 5, the filter cap 30 is disposed about a central axis 32 and is comprised of a disk 34 and a flange 36 which extends in one direction from the disk terminating in an edge 37 so as to define a cylindrical space 38.

Projecting inwardly in a radially orientation from the circular flange 36 are a plurality of rectangular lugs 40. The rectangular lugs 40 adjoin both the inner surface 42 of the disk 34 and the inner surface 46 of the circular flange 36 to define a unitary structure. Each lug 40 has first and second radially extending side surfaces 50 and 52; a radially facing end surface 56 and a radially extending exposed surface 58. There is a second space 59 defined by the end surfaces 56 of the lugs 40 which accommodates any central projections on the cover 8 (see FIG. 10). Preferably, the entire wrench cap 30 is a molded plastic unit.

When the wrench cap 30 is placed over the cover 8, the bottom surface 37 of the circular flange 36 engages the peripheral area 22 of the disk 12 with the lugs 40 fitting in the gaps 20 between the ribs 14. In the cover embodiment of FIGS. 2–4 where the ribs 14 are T-shaped, the gaps 20 are between the cross members 16 of the ribs 14. Consequently, when the wrench cap 30 is rotated about its axis 32, one of the radially extending faces 52 and 54 engages the ribs 14 at the ends of the cross members 16. Whether it is the faces 52 or the faces 54 which engage the ribs 14 depends on which direction the wrench cap is turned. For unscrewing the wrench cap 30, the wrench cap is rotated counterclockwise. Moreover, the wrench cap can not slip radially with respect to the cover 8 because the cross members 16, the ribs 14 engage the inner wall 46 of the circular flange 30. Preferably, the edge 37 of the circular flange 36 abuts the peripheral surface 25 while the exposed surfaces 58 of the lugs 40 also rest on the top surface 15 of the disk 12. Consequently, the wrench cap 30 can nest snugly against the filter cover 8.

As is seen in FIG. 6, the cap wrench 30 has a projecting hex nut 70 which extends from the outside surface 72 thereof. The hex nut 70 has six flat sides 74 and a central square aperture 76 which projects through the inside wall 36, as is seen in FIG. 5. Hex nut 70 is molded unitary with the wrench cap 30 above the axis 32 so that when torque is applied to the hex nut 70 or to the aperture 76, the wrench cap 30 rotates the filter cover 8 (see FIGS. 2–4). By having the plurality of surfaces 74 and a square aperture 76 he hex nut 30 provides a coupling with a surface configuration which is adapted to complement a plurality of surface configurations on various wrenches and wrench handles.

Figure 7:
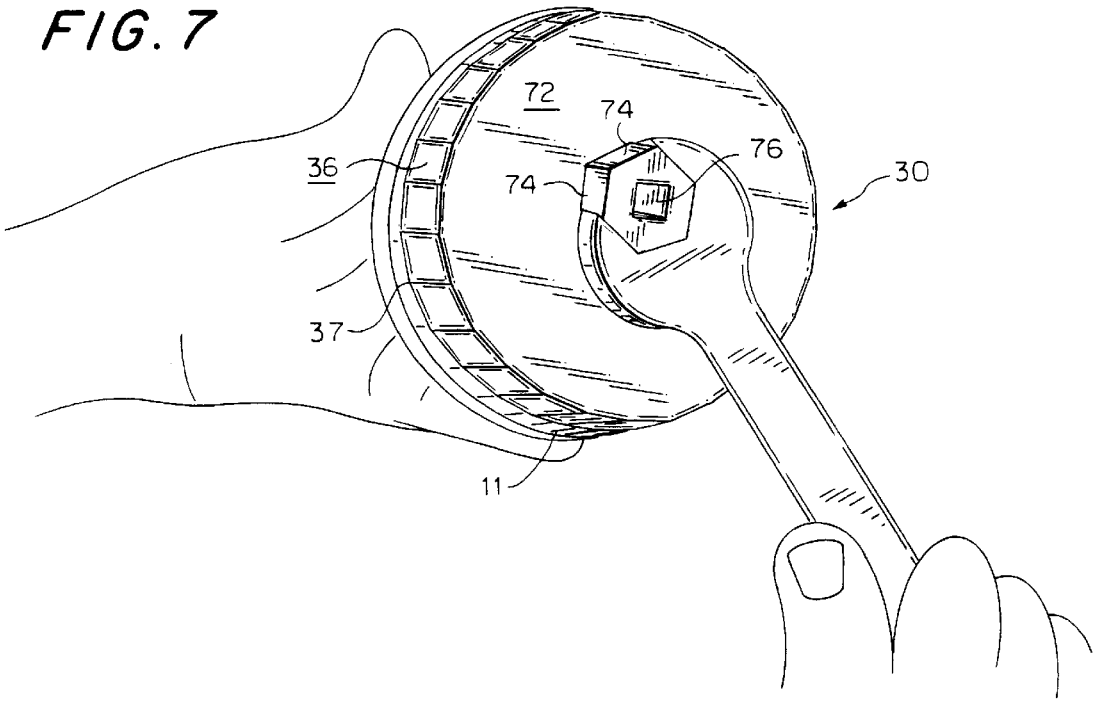
FIG. 7 is a top view showing an open wrench being applied to the outside of the wrench cap of FIGS. 5 and 6.
Figure 8:
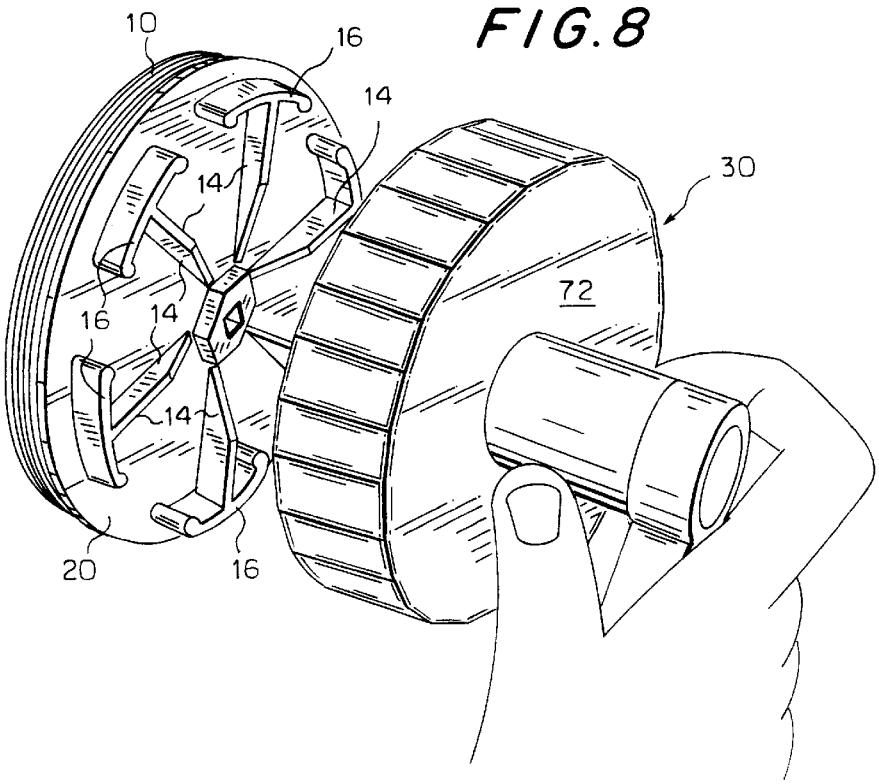
FIG. 8 is a view of a socket with a rachet being applied to the wrench cap of FIGS. 5 and 6.
Figure 9:
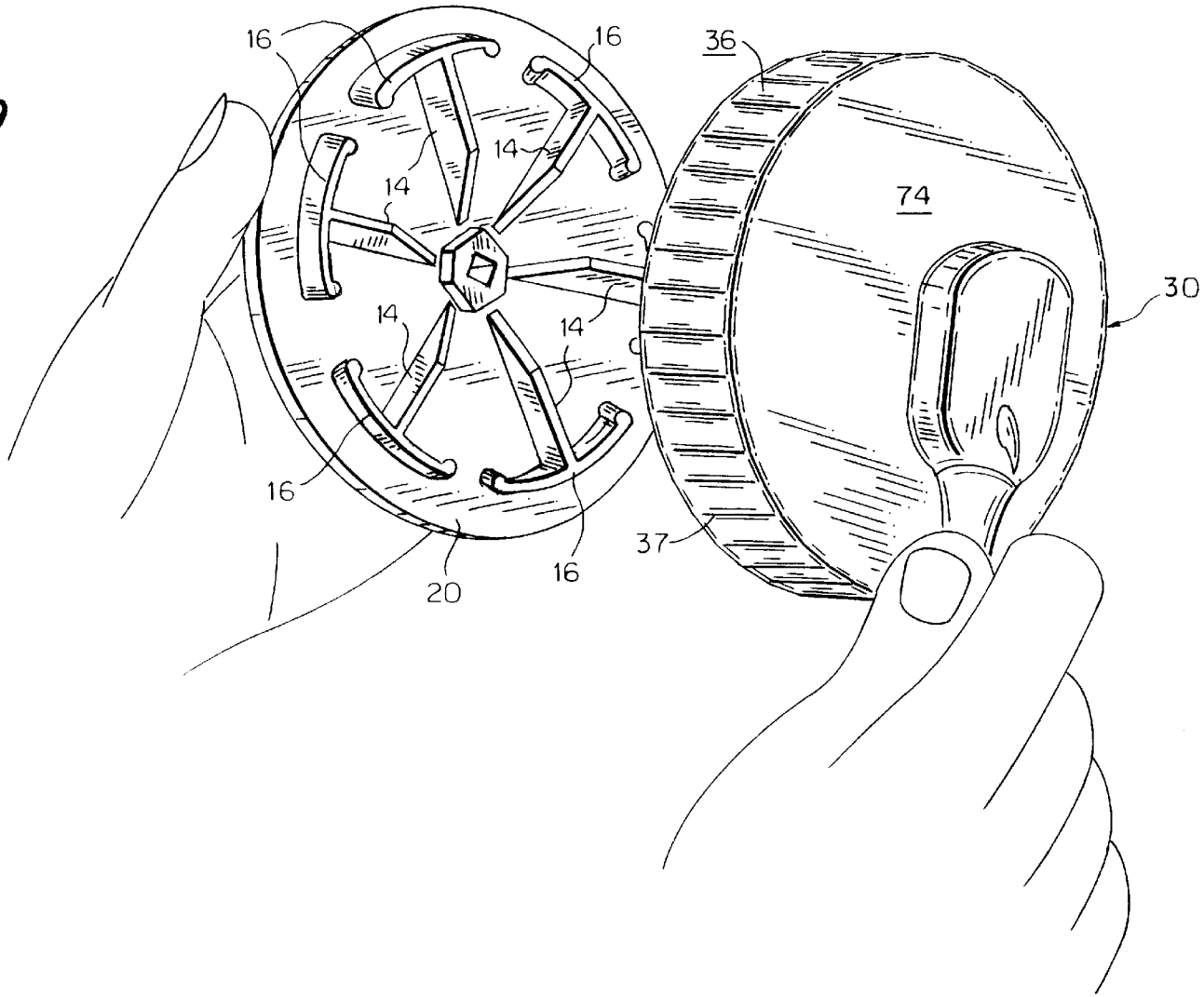
FIG. 9 is a view of a socket rachet coupling being applied directly to the wrench cap of FIGS. 5 and 6.

As is seen in FIGS. 7, 8 and 9, the hex nut coupling 70 complements various wrenches used frequently by mechanics such as an open wrench 80 (FIG. 7) which could also be a closed wrench; a socket wrench 82 (FIG. 8) or the rectangular projection of a socket wrench handle 84 (see FIG. 9).

Figure 10:
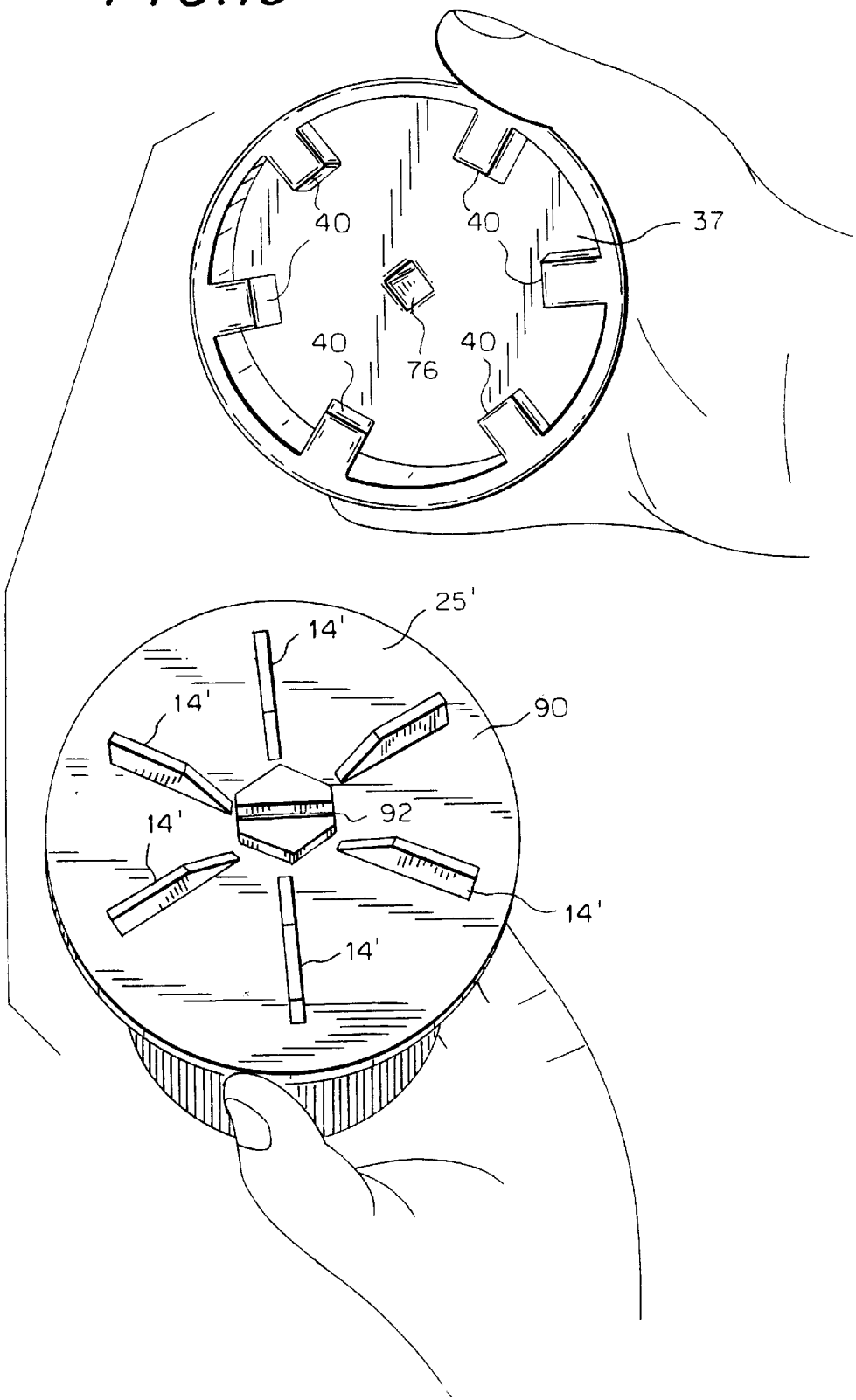
FIG. 10 is a perspective view of the wrench cap of the present invention shown for use with another embodiment of filter cover, wherein the filter cover is integral with the filter element.

Referring now to FIG. 10, the wrench cap 30 is usable with another embodiment 8' of the filter cap wherein a filter cap 8' is integral with a filter element 9'. Like the filter cap 8, the filter cap 8' has a threaded portion 11' which is threaded into the housing 7. However, the top surface 90 of the filter cap 8' is different in that it includes straight linear ribs 14' without cross members 16. The lugs 40 align with spaces 20' between the rib 14' and engage the ribs 14' when the wrench cap 30 is rotated so that the wrench cap can apply torque to and unscrew the filter cap 8' when rotated counterclockwise and thus allow removal of the filter element 9' from its housing 7 (see FIGS. 2–4). The cover 8' includes a hex nut projection 92 which is accommodated in the space 59 defined between the lugs 40 of the wrench cap so that the cap wrench can engage the peripheral portion 25' with its edge 37.

From the foregoing description, one skilled in the art can easily ascertain the essential characteristics of this invention and, without departing from the spirit and scope thereof, can make various changes and modifications of the invention to adapt it to various usages and conditions.

We claim:

1. A wrench cap adapted to remove a cover of a fuel filter housing, wherein the cover includes a top surface with a peripheral portion and an array of radial ribs having selected radial extent terminating at the peripheral portion to define a rib-free area of a selected width and maximum diameter, the disk cover having a threaded portion thereon for threadably coupling with a threaded mouth of the housing to retain a filter element within the housing, the wrench cap comprising:

a disk having a diameter larger than the radial extent of the ribs;

a flange extending from the disk and enclosing a space having a diameter larger than the radial extent of the ribs but less than the maximum diameter of the peripheral portion, the flange having an edge adapted to engage the peripheral portion of the top surface of the disk cover;

a plurality of lugs spaced from one another and extending inwardly from the flange, the lugs being adapted to engage the ribs in a circumferential direction to apply torque to the cover, the flange being adapted to engage the ends of the ribs in the radial direction to keep the wrench cap from slipping radially with respect to the cover, and a coupling on the disk adapted to couple with a wrench handle for applying torque to the disk.

2. The wrench cap of claim 1 wherein the coupling on the disk has a surface configuration adapted to complement a surface configuration on the handle.

3. The wrench cap of claim 2 wherein the coupling on the disk has a surface configuration adapted to complement a plurality of surface configurations on various wrenches and wrench handles.

4. The wrench cap of claim 3 wherein the coupling on the handle is a projecting hex nut having a square aperature therethrough, wherein the hex nut cooperates with either an open or closed end wrench or socket, and wherein the square aperature receives a square coupling of a ratchet drive.

5. The wrench cap of claim 3 wherein the wrench cap is a plastic molding.

6. The wrench cap of claim 1 in combination with the cover of the fuel filter housing wherein the ribs are straight linear members and wherein there is a hex nut projecting from the top surface.

7. The wrench cap in combination of claim 6 wherein there are six ribs on the cover and six lugs on the wrench.

8. The wrench cap of claim 1 in combination with the cover of the fuel filter housing wherein the ribs are T-shaped with arcuate lateral portions having gaps therebetween for receiving the lugs on the wrench therebetween.

9. The wrench cap in combination of claim 8 wherein there are six ribs on the cover and six lugs on the wrench.

10. The wrench cap of claim 1 wherein there are six lugs.

11. The wrench cap of claim 1 wherein the lugs are rectangular and extend radially toward the axis of the disk, terminating to define a space adjacent the axis of the wrench cap, the space adapted to receive a projecting member on the cover.

* * * * *